US011526100B2

(12) United States Patent
Fukase et al.

(10) Patent No.: US 11,526,100 B2
(45) Date of Patent: Dec. 13, 2022

(54) IMAGE FORMING APPARATUS

(71) Applicant: CANON KABUSHIKI KAISHA, Tokyo (JP)

(72) Inventors: Yasuhiro Fukase, Kanagawa (JP); Akinori Mitsumata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/355,745

(22) Filed: Jun. 23, 2021

(65) Prior Publication Data

US 2021/0405556 A1 Dec. 30, 2021

(30) Foreign Application Priority Data

Jun. 24, 2020 (JP) ..... JP2020-109157

(51) Int. Cl.

| | |
|---|---|
| ***G03G 15/16*** | (2006.01) |
| ***G03G 15/00*** | (2006.01) |
| ***G03G 15/20*** | (2006.01) |

(52) U.S. Cl.

CPC ..... *G03G 15/16* (2013.01); *G03G 15/2017* (2013.01); *G03G 15/50* (2013.01)

(58) Field of Classification Search

CPC ..... G03G 15/16; G03G 15/2017; G03G 15/50
See application file for complete search history.

(56) References Cited

U.S. PATENT DOCUMENTS

| | | | | |
|---|---|---|---|---|
| 8,244,168 | B2 | 8/2012 | Ehara et al. | |
| 2021/0405576 | A1* | 12/2021 | Fukase ..... | G03G 15/2032 |

FOREIGN PATENT DOCUMENTS

| | | | |
|---|---|---|---|
| JP | 2009-003304 | A | 1/2009 |
| JP | 2009-294357 | A | 12/2009 |
| JP | 2014-081425 | A | 5/2014 |
| JP | 2014-122960 | A | 7/2014 |

OTHER PUBLICATIONS

U.S. Appl. No. 17/355,758, Yasuhiro Fukase Akinori Mitsumata, Jun. 23, 2021.

* cited by examiner

*Primary Examiner* — Clayton E. LaBalle
*Assistant Examiner* — Michael A Harrison
(74) *Attorney, Agent, or Firm* — Venable LLP

(57) ABSTRACT

A cancellation operation of a fixing nip and movement of a transfer roller are interlocked with each other. In the image forming apparatus, at least a first state in which the relative position is arranged at a fixing position and the transfer roller is arranged at a transfer position, a second state in which the relative position is arranged at a transfer nip cancellation position and the transfer roller is arranged at a transfer nip cancellation position, and a third state in which the relative position is arranged at a fixing nip cancellation position and the transfer roller is arranged at one of an intermediate position between the transfer position and the transfer nip cancellation position and the transfer position may be taken as a combination state of the relative position between the fixing roller and the facing member and the position of the transfer roller.

10 Claims, 11 Drawing Sheets

FIG.5

| | A | B | C | D |
|---|---|---|---|---|
| FIXING NIP | FIXING POSITION | PRESSURE CANCELLATION POSITION | FIXING POSITION | PRESSURE CANCELLATION POSITION |
| SECONDARY TRANSFER ROLLER 12 | CONTACT | SEPARATED | SEPARATED TO CONTACT | CONTACT |
| STATE | ORDINARY | SHIPMENT AND LONG-TERM STORAGE | – | PAPER JAM HANDLING |

FIG.7

| | A | B | C | D |
|---|---|---|---|---|
| FIXING NIP | FIXING POSITION | PRESSURE CANCELLATION POSITION | FIXING POSITION | PRESSURE CANCELLATION POSITION |
| SECONDARY TRANSFER ROLLER 12 | CONTACT | SEPARATED | SEPARATED TO SLIGHTLY SEPARATED WITH REDUCED PRESSURE | SLIGHTLY SEPARATED WITH REDUCED PRESSURE |
| STATE | ORDINARY | SHIPMENT AND LONG-TERM STORAGE | – | PAPER JAM HANDLING |

IMAGE FORMING APPARATUS

BACKGROUND OF THE INVENTION

Field of the Invention

The present invention relates to an image forming apparatus using an electrophotographic system or an electrostatic recording system such as a copier, a multifunction machine, and a laser beam printer.

Description of the Related Art

Conventionally, the configuration of the above image forming apparatus has been known in which a transfer roller serving as a transfer member is caused to contact a photosensitive drum serving as an image bearing member bearing a toner image via a conveying belt, an intermediate transfer belt, or the like to form an image. If the transfer roller is stored for a long period of time in a state of contacting the photosensitive drum, the conveying belt, the intermediate transfer belt, or the like provided at a position of facing, there is a likelihood that the shapes of the transfer roller, the conveying belt, and the intermediate transfer belt are locally deformed by a transfer pressure.

In order to avoid the local deformation, there has been a configuration such as separating the transfer roller from the photosensitive drum, the conveying belt, the intermediate transfer belt, or the like serving as a facing member and reducing a transfer pressure.

Japanese Patent Application Laid-open No. 2009-294357 discloses a configuration in which a photosensitive drum and a transfer belt are separated from each other by a cam rotating operation when an apparatus stops and a configuration in which a transfer unit is supported by an openable/closable door to easily take out a recording material stuck when a jam occurs. Further, Japanese Patent Application Laid-open No. 2009-294357 discloses a configuration that prevents, since a load for closing a door is increased if a cam stops rotation thereof with a transfer belt separated when the door is opened, an increase in the load. More specifically, a mechanism for moving the cam so as to reduce a load applied to the door in conjunction with a door opening operation is provided to reduce a load when the door is closed.

SUMMARY OF THE INVENTION

However, since it is necessary to separately provide a space for reducing the load to close the door in the apparatus in the configuration of Japanese Patent Application Laid-open No. 2009-294357, it has been difficult to achieve the miniaturization and space saving of the apparatus.

In view of this, the present invention has an object of reducing a load when a transfer unit is closed without upsizing an apparatus in the image forming apparatus having the transfer unit openable and closable to open the apparatus.

In order to achieve the object, an image forming apparatus according to the present invention includes:

an apparatus body thereof;

an image bearing member that is provided in the apparatus body and bears a toner image;

a transfer roller that forms a transfer nip to sandwich a recording material between the transfer roller and the image bearing member and transfers the toner image onto the recording material inside the apparatus body;

a transfer unit that is provided in the apparatus body to be movable to an opening position for opening the inside of the apparatus body and to a closing position for closing the inside of the apparatus body, at the closing position, the transfer unit supporting the transfer roller to be movable to a transfer position, at which the transfer unit forms the transfer nip with the image bearing member, and to a transfer nip cancellation position, at which the transfer unit does not form the transfer nip with the image bearing member;

a transfer nip control member that is provided in the apparatus body to be movable to a pressing position, at which the transfer nip control member applies a pressing force for positioning the transfer roller at the transfer nip cancellation position to the transfer unit at the closing position, and to a cancellation position, at which the transfer nip control member cancels the pressing force;

a fixing portion that has a fixing roller for forming a fixing nip to sandwich the recording material and a facing member facing the fixing roller and fixes the toner image onto the recording material; and a fixing nip control mechanism for changing a relative position between the fixing roller and the facing member to a fixing position, at which the fixing nip is formed, and a fixing nip cancellation position, at which the fixing nip is not formed, wherein the image forming apparatus includes an interlocking mechanism for moving the transfer nip control member from the cancellation position to the pressing position in conjunction with a cancellation operation of the fixing nip by the fixing nip control mechanism, and the image forming apparatus is capable of taking, as a combination state of a relative position between the fixing roller and the facing member and a position of the transfer roller, at least (i) a first state in which the relative position is arranged at the fixing position and the transfer roller is arranged at the transfer position, (ii) a second state in which the relative position is arranged at the fixing nip cancellation position and the transfer roller is arranged at the transfer nip cancellation position, and (iii) a third state in which the relative position is arranged at the fixing nip cancellation position and the transfer roller is arranged at at least one of an intermediate position between the transfer position and the transfer nip cancellation position, and the transfer position.

As described above, the present invention makes it possible to reduce a load when a transfer unit is closed without upsizing an apparatus in the image forming apparatus having the transfer unit openable and closable to open the apparatus.

Further features of the present invention will become apparent from the following description of exemplary embodiments with reference to the attached drawings.

BRIEF DESCRIPTION OF THE DRAWINGS

FIG. 5 is a view showing the positional relationship between a fixing unit and the secondary transfer unit in the first embodiment;

FIG. 7 is a view showing the positional relationship between a fixing unit and the secondary transfer unit in the second embodiment;

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments are not intended to limit the scope of the invention to the following embodiments.

First Embodiment

Figure 10:
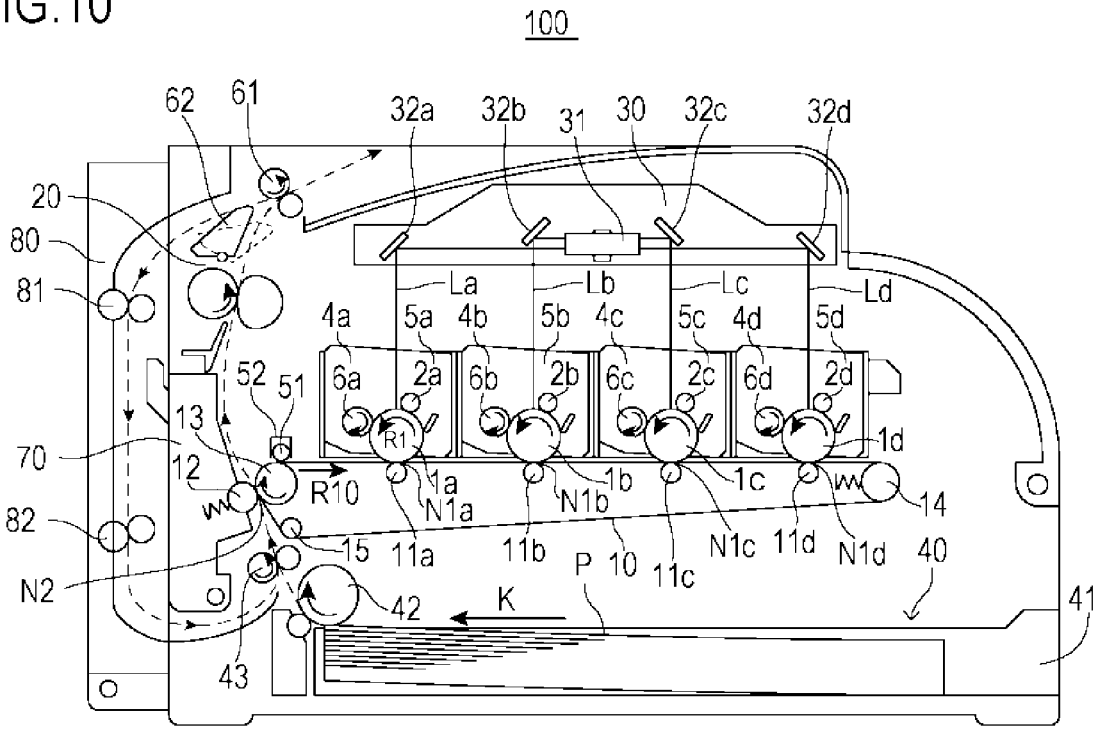
FIG. 10 is a schematic view showing the configuration of an image forming apparatus in the first embodiment.

FIG. 10 is a schematic view showing the schematic configuration of an image forming apparatus 100 according to the present invention. Note that the image forming apparatus shown in FIG. 10 is an electrophotographic system tandem-type four-color laser beam printer and uses an intermediate transfer belt 10 as an intermediate transfer member. Hereinafter, the configuration of the image forming apparatus 100 will be briefly described.

The image forming apparatus 100 shown in FIG. 10 includes drum-type electrophotographic photosensitive members (hereinafter called "photosensitive drums") 1*a* to 1*d* as first image bearing members for respective colors in an apparatus body. The photosensitive drums 1*a* to 1*d* are rotatably supported by the image forming apparatus 100 and rotationally driven in an arrow R1 direction by a driving unit (not shown). Around the photosensitive drums 1*a* to 1*d*, contact-type charging rollers 2*a* to 2*d* that uniformly charge the surfaces of the photosensitive drums 1*a* to 1*d* and developing apparatuses 4*a* to 4*d* that attach toner to electrostatic latent images using developing rollers 6*a* to 6*d* to be developed as toner images are arranged along the rotating directions. Further, an exposure apparatus 30 that irradiates the surfaces of the photosensitive drums 1*a* to 1*d* with laser light La to Ld according to image information to form electrostatic latent images is arranged over the respective photosensitive drums 1*a* to 1*d*. In addition, an intermediate transfer belt (intermediate transfer member) 10 serving as a second image bearing member onto which toner images on the photosensitive drums 1*a* to 1*d* are to be primarily transferred is arranged so as to contact the photosensitive drums 1*a* to 1*d*. Furthermore, photosensitive drum cleaning apparatuses 5*a* to 5*d* that remove primarily-untransferred toner on the surfaces of the photosensitive drums 1*a* to 1*d* are arranged. In addition, a control portion 7 is provided as a unit for controlling the operation of the image forming apparatus 100 and gives and receives various electric information signals. Note that constituting elements having common function configurations among those denoted by symbols a to d will be described without the symbols a to d in the following description.

Primary transfer rollers 11 are arranged on the inner peripheral surface of the intermediate transfer belt 10 and press the intermediate transfer belt 10 to the surfaces of the photosensitive drums 1 to form a primary transfer nip portion N1 between the photosensitive drums 1 and the intermediate transfer belt 10. A primary transfer bias is applied to the primary transfer rollers 11 by a power supply (not shown). Further, a secondary transfer roller 12 is arranged on the outer surface side of the intermediate transfer belt 10, that is, at a position facing a driving roller 13 (facing roller) on the inner side surface of the intermediate transfer belt 10 and forms a secondary transfer nip portion N2 with the intermediate transfer belt 10. A secondary transfer bias is applied to the secondary transfer roller 12 by a power supply (not shown). Further, the image forming apparatus of the present embodiment is configured to be capable of measuring a current value in respective image forming processes that will be described later. Furthermore, the control portion 7 also functions as, for example, a discrimination unit for discriminating the position of the secondary transfer roller 12 using a measured current value.

In addition, a cleaning roller (roller charging device) 51 of an electrostatic-type intermediate transfer belt cleaning apparatus 52 is disposed so as to face the outer peripheral surface of the intermediate transfer belt 10 on the downstream side of the secondary transfer nip portion N2 and on the upstream side of the primary transfer nip portion N1.

A transferred-material supply apparatus 40 feeds a transferred material P to an image forming portion constituted by the photosensitive drums 1, the charging rollers 2, the developing rollers 6, the exposure apparatus 30, the photosensitive drum cleaning apparatus 5, or the like. The transferred-material supply apparatus 40 is configured to include a transferred-material cassette 41 accommodating a plurality of transferred materials P (recording materials), a supply roller 42, a resist roller 43, or the like.

Furthermore, a fixing unit 20 that heats and pressurizes toner images transferred onto a transferred material P to be fixed is disposed on the downstream side of the secondary transfer nip portion N2 in the conveying direction (arrow K direction) of the transferred material P.

The image forming apparatus 100 thus configured will be described in detail below. The photosensitive drums 1 described above are constituted by an aluminum cylinder and a photoconductive layer such as an OPC (Organic Photoconductor) provided on the outer peripheral surface of the aluminum cylinder. The charging rollers 2 are constituted by a cored bar and a conductive elastic member surrounding the periphery of the cored bar. The charging rollers 2 are arranged in contact with the surfaces of the photosensitive drums 1 to be driven and rotated, while a charging bias is applied to the photosensitive drums 1 by a power supply (not shown).

The exposure apparatus 30 has a laser oscillator (not shown) that emits laser light L according to image information, a polygon mirror 31, mirrors 32, or the like. The exposure apparatus 30 exposes the surfaces of the photosensitive drums 1 that have been charged according to image information to form electrostatic latent images. The developing apparatuses 4 are arranged at developing positions facing the surfaces of the photosensitive drums 1 to be subjected to the developing of electrostatic latent images on the photosensitive drums 1. Then, the developing apparatuses 4 develop the electrostatic latent images on the photosensitive drums 1 to form toner images. This process is performed for the respective colors.

The intermediate transfer belt 10 is formed into an endless shape and laid over three support rollers arranged parallel to each other, the driving roller 13, a tension roller 14, and an auxiliary roller 15. The tension roller 14 is driven and rotated and stretches the intermediate transfer belt 10. The intermediate transfer belt 10 is driven (run) in an arrow R10 direction as the driving roller 13 is rotated by a driving unit (not shown).

Next, the operation of the image forming apparatus thus configured will be described. The surface of the photosensitive drum 1*a* rotated and driven in the arrow R1 direction is uniformly charged by the application of a charging bias composed of a DC voltage and an AC voltage superposed one on the other to the charging roller 2*a*. When the image signal of yellow is input to a laser oscillator (not shown), the surface of the charged photosensitive drum 1*a* is irradiated with laser light La. As a result, an electrostatic latent image is formed on the photosensitive drum 1*a*. When the photosensitive drum 1*a* is further rotated in the arrow R1 direction, yellow toner is attached to the electrostatic latent image on the photosensitive drum 1*a* by a yellow developing device 4*a* to be developed as a toner image. The yellow toner image on the photosensitive drum 1*a* is primarily transferred onto the intermediate transfer belt 10 via a primary transfer nip portion N1*a* by a primary transfer bias applied to a primary transfer roller 11*a*. After the transfer of the yellow toner image, primarily-untransferred toner on the surface of the photosensitive drum 1*a* is removed by the photosensitive drum cleaning apparatus 5*a*, and then the photosensitive drum 1*a* is subjected to next image formation.

A series of the respective image formation processes of charging, exposure, developing, primary transfer, and cleaning described above is repeatedly performed also for the other three colors, that is, magenta, cyan, and black in consideration of the intervals between respective primary transfer nip portions N1*a* to N1*d*. As a result, toner images of the totally four colors are formed on the intermediate transfer belt 10.

The toner images of the four colors on the intermediate transfer belt 10 are secondarily transferred onto a transferred material P conveyed in an arrow K direction via the secondary transfer nip portion N2 by a secondary transfer bias applied to the secondary transfer roller 12 by the power supply.

After the transfer of the toner images by the secondary transfer nip portion N2, the transferred material P is conveyed to the fixing unit 20. Here, the transferred material P is heated and pressurized to be melted and stuck (fixed). Thus, a full four-color image is obtained on the transferred material P. After that, the transferred material P is discharged by a paper discharging inversion roller 61.

When double-sided printing is performed, a flapper 62 is moved to a double-sided conveying position by a driving unit (not shown) after a part near the rear end of the transferred material P reaches the paper discharging inversion roller 61. Then, the paper discharging inversion roller 61 is reversely rotated by a driving unit (not shown) to feed the transferred material P to a double-sided unit 80. Next, the transferred material P is conveyed to a resist roller 43 by an upper roller 81 and a lower roller 82. After that, printing is performed on a second side like a first side (that is, printing is performed on both sides), and the transferred material P is discharged.

On the other hand, secondarily-untransferred toner that has not been transferred onto the transferred material P remains on the intermediate transfer belt 10 after the transfer of the toner images. The residual toner on the intermediate transfer belt 10 is collected at the photosensitive drum cleaning apparatuses 5*a* to 5*d* via the photosensitive drums 1*a* to 1*d* by the intermediate transfer belt cleaning apparatus 52. That is, when charges having an opposite polarity, that is, positive charges are applied to the residual toner by an intermediate transfer belt cleaning unit, the residual toner is reversely transferred onto the photosensitive drums 1*a* to 1*d* via the primary transfer nip portions N1*a* to N1*d*. The reversely-transferred secondarily-untransferred toner is removed by the photosensitive drum cleaning apparatuses 5*a* to 5*d* together with the primarily-untransferred toner on the photosensitive drums 1*a* to 1*d*.

Figure 1:
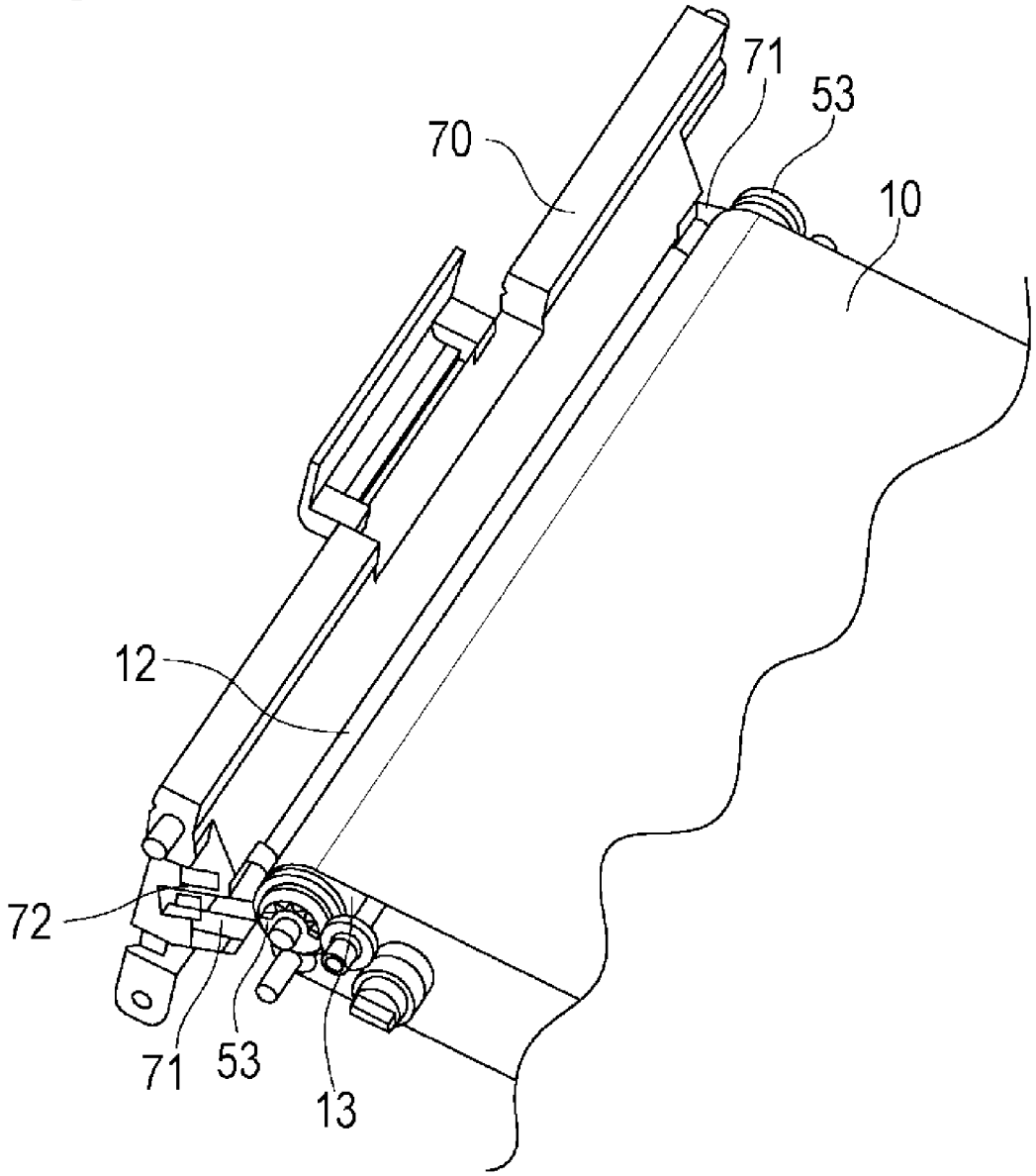
FIG. 1 is an explanatory view of a part near a secondary transfer roller in a first embodiment.

Next, a configuration peculiar to the present embodiment will be described with reference to FIGS. 1 to 7. FIG. 1 is an explanatory view of a part near the secondary transfer roller 12 in the image forming apparatus 100 according to the present embodiment. Separation cams 53 (cam members) for separating the secondary transfer roller 12 are provided near both ends of the intermediate transfer belt 10 coaxial with the driving roller 13.

A secondary transfer unit 70 is provided with the secondary transfer roller 12 and bearings 71 having surfaces that contact the separation cams 53 that will be described later at both ends of the secondary transfer roller 12. At both ends of the secondary transfer roller 12, one of the bearings 71 is provided with a conductive member (not shown) for applying a bias to the secondary transfer roller 12 and thus is not the same component as the other of the bearings 71. The secondary transfer roller 12 is pressed by a secondary transfer spring 72 serving as a transfer urging member via the bearings 71 and the conductive member (not shown), and the reaction force of the secondary transfer spring 72 is received by the secondary transfer unit 70. The secondary transfer unit 70 is rotatably configured to be opened and closed with respect to the apparatus body of the image forming apparatus 100 (movable to a closing position for closing the apparatus body and an opening position for opening the apparatus body). If a paper jam or the like occurs, the secondary transfer unit 70 is moved to the opening position to open the apparatus body so that a user is allowed to handle the paper jam.

When the separation cams 53 serving as transfer nip control members are rotated in a state in which the secondary transfer unit 70 is closed, the bearings 71 are moved against the urging force of the secondary transfer spring 72 by a pressing force received from the separation cams 53. Thus, the secondary transfer roller 12 is movable to a contact position (transfer position) at which the secondary transfer roller 12 contacts the intermediate transfer belt 10 and a separation position (transfer nip cancellation position) at which the secondary transfer roller 12 is separated from the intermediate transfer belt 10.

Figure 2B:
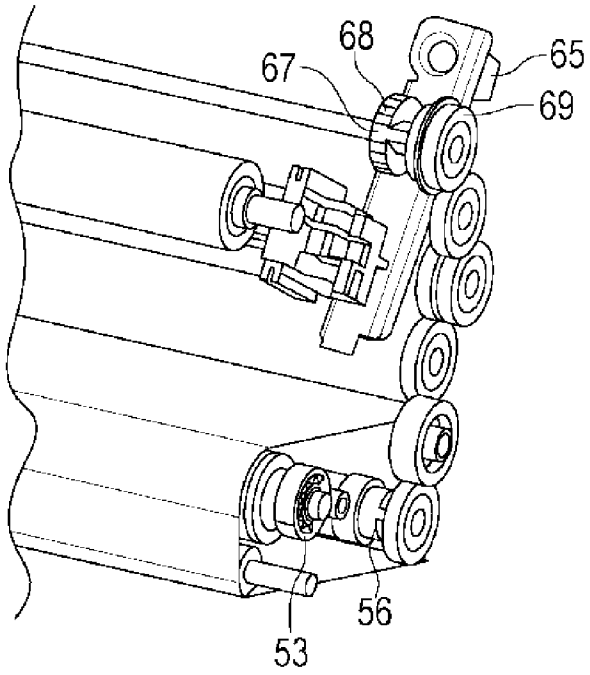
FIGS. 2A and 2B are perspective views showing the driving configuration of separation cams in the first embodiment.
Figure 2A:
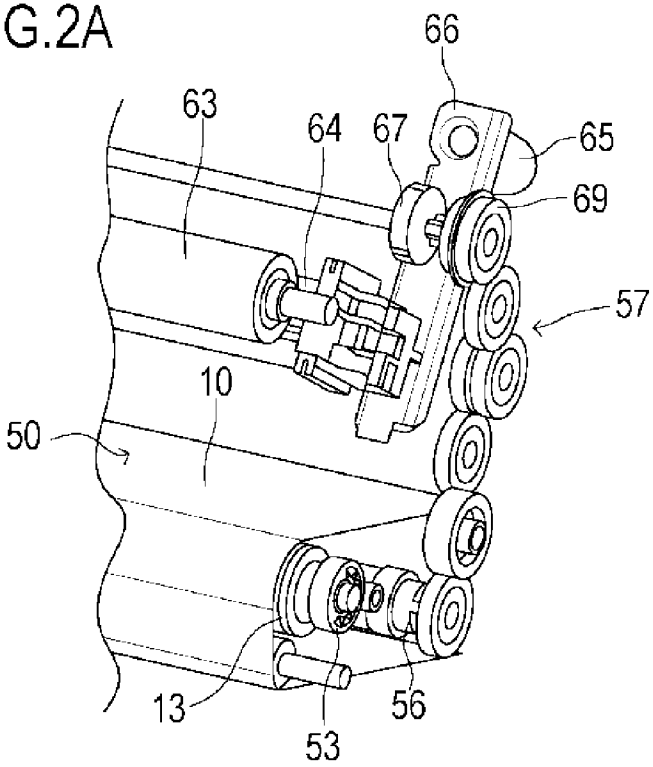
Figure 3:
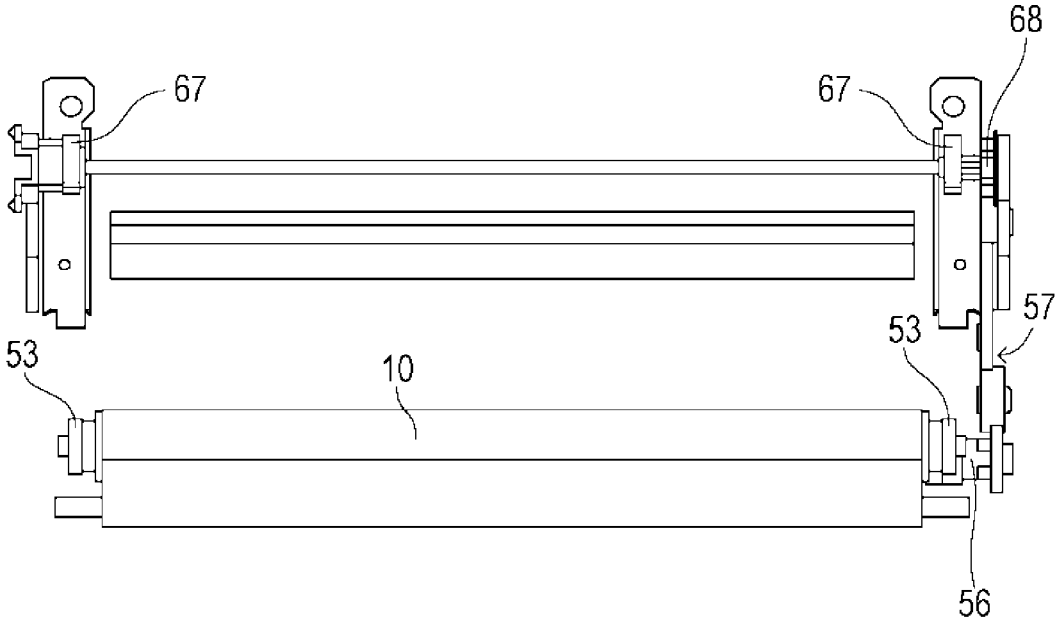
FIG. 3 is a schematic view of a driving configuration when seen from the side of a secondary transfer unit in the first to third embodiments.

Next, the driving configuration of the separation cams 53 will be described with reference to FIGS. 2A and 2B and FIG. 3. FIGS. 2A and 2B show perspective views of the driving configuration. FIG. 3 shows the outline of the driving configuration when seen from a body back-surface side (the side of the secondary transfer unit 70). A fixing unit 60 (fixing portion) forms a fixing nip for sandwiching a transferred material P with heating members 64 serving as facing members that face a fixing roller 63, and presses pressurization plates 66 with fixing springs 65 serving as fixing urging members to pressurize the heating members 64. Then, the fixing unit 60 heats toner images to be melted and stuck (fixed).

In the case of a paper jam or long-term storage, fixing cams 67 (fixing cam members) are rotated by about 180 degrees as a fixing nip control mechanism to rotate the pressurization plates 66. Thus, the relative position between the fixing roller 63 and the heating members 64 is periodically changed from a fixing position at which the fixing nip is formed to a fixing nip cancellation position to cancel (or reduce) a fixing nip pressure. The image forming apparatus 100 according to the present embodiment includes an interlocking mechanism for moving the separation cams 53 that rotate about a rotational axis from the cancellation position to the pressing position in conjunction with the cancellation operation of the fixing nip by the fixing nip control mechanism. A driving transmission portion 68 is provided on a shaft that drives the fixing cams 67 and engages a driven transmission portion 69 that is provided in the body and has a gear. Drive is transmitted from the driven transmission portion 69 to a separation cam engaging portion 56 near an intermediate transfer unit 50 via a gear train 57. Before being transmitted from the separation cam engaging portion 56 to gears inside the intermediate transfer unit 50 and transmitted onto the shaft of the driving roller 13, the drive is divided to a part near the other end of the intermediate transfer belt 10 via a shaft. After that, the drive is transmitted to the separation cams 53 at both ends on the shaft of the driving roller 13.

A reduction gear ratio from the fixing cams 67 to the separation cams 53 is 2:1. That is, the separation cams 53 are rotated by about 90 degrees when the fixing cams 67 are rotated by about 180 degrees. When the fixing cams 67 are rotated by a prescribed angle, the rotation angle of the separation cams 53 is configured to be smaller than or substantially half of the rotation angle of the fixing cams 67 in the present embodiment. When the relative position between the fixing roller 63 and the heating members 64 is arranged at the fixing position at which the fixing nip is formed and a printable condition is created with a fixing nip pressure (FIG. 2A), the secondary transfer roller 12 is arranged at a contact position at which the secondary transfer roller 12 contacts the intermediate transfer belt 10. On the other hand, when the relative position between the fixing roller 63 and the heating members 64 is arranged at the fixing nip cancellation position and a fixing nip pressure is cancelled (reduced) (FIG. 2B), the secondary transfer roller 12 is arranged at a position at which the secondary transfer roller 12 is rotated by 90 degrees from the contact position. A current value generated when the fixing nip is formed and a current value generated when the fixing nip is not formed are measured by a phase detection unit 95 for a fixing nip pressure provided in the fixing unit 60 to compare a fixing phase at which the fixing position is formed with a fixing nip cancellation phase at which the fixing nip cancellation position is formed. A printable fixing position and a pressure cancellation position (fixing nip cancellation position) are detected by a compared result.

Figure 4A:
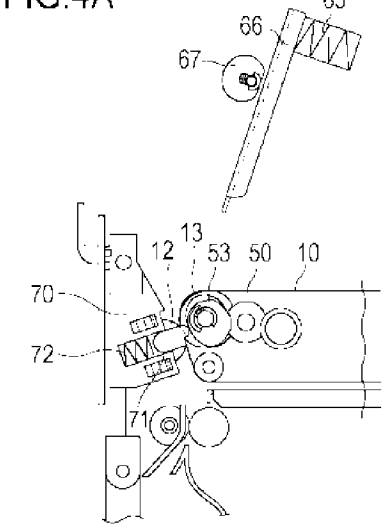
FIGS. 4A to 4F are schematic views showing the contact and separation of the secondary transfer roller in the first embodiment.

Next, the contact and separation of the secondary transfer roller 12 will be described with reference to FIGS. 4A to 4F and FIG. 5. FIGS. 4A to 4F are views showing the contact and separation of the secondary transfer roller 12. FIG. 5 is a view showing the positional relationship between the fixing unit 60 and the secondary transfer unit 70. FIG. 4A shows a state in which the relative position between the fixing roller 63 and the heating members 64 of the fixing unit 60 is arranged at the fixing position, the secondary transfer unit 70 is arranged at the closing position, and a printable condition is created. This state corresponds to the state of A in FIG. 5. That is, the fixing cams 67 are not in contact with the pressurization plates 66 in the fixing unit 60, and the fixing nip is not cancelled. The bearings 71 are not pressed by the separation cams 53 in the secondary transfer unit 70, and the secondary transfer roller 12 is arranged at the contact position (transfer position) at which the secondary transfer roller 12 contacts the intermediate transfer belt 10.

Figure 4B:
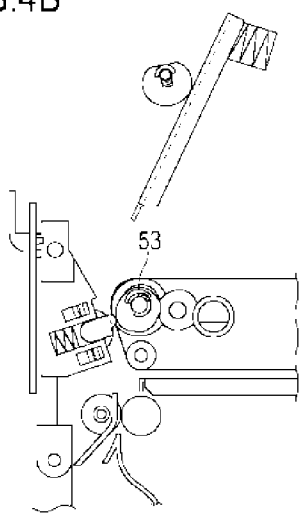
Figure 4C:
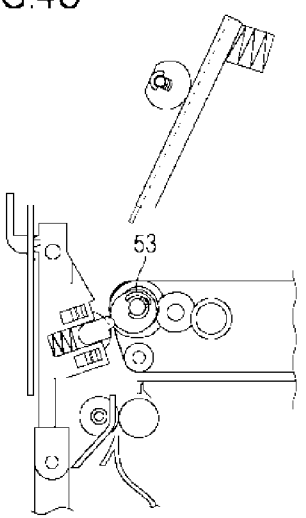

Here, when the fixing cams 67 are rotated by about 180 degrees as shown in FIG. 4C, the pressurization plates 66 are pressed by the fixing cams 67 and the relative position between the fixing roller 63 and the heating members 64 of the fixing unit 60 is arranged at the fixing nip cancellation position. Therefore, a fixing nip pressure is cancelled. At this time, the separation cams 53 are rotated by about 90 degrees. As a result, the bearings 71 are retreated by being pressed by the separations cams 53, and the secondary transfer roller 12 is moved from the contact position (transfer position) to the separation position (transfer nip cancellation position) and separated from the intermediate transfer belt 10. This position is used at the time of shipment from a factory, long-term storage during usage by a user, or the like. Note that the state of FIG. 4C corresponds to the state of B in FIG. 5.

Figure 4D:
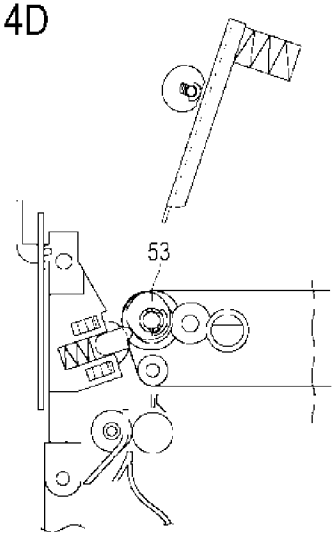

When the fixing cams 67 are further rotated by about 180 degrees as shown in FIG. 4D, the fixing cams 67 are separated from the pressurization plates 66 and the relative position between the fixing roller 63 and the heating members of the fixing unit 60 is arranged at the fixing position again. The separation cams 53 are further rotated by about 90 degrees, and the secondary transfer roller 12 is moved from the separation position to the contact position. Note that the state of FIG. 4D corresponds to the state of C in FIG. 5.

Figure 4E:
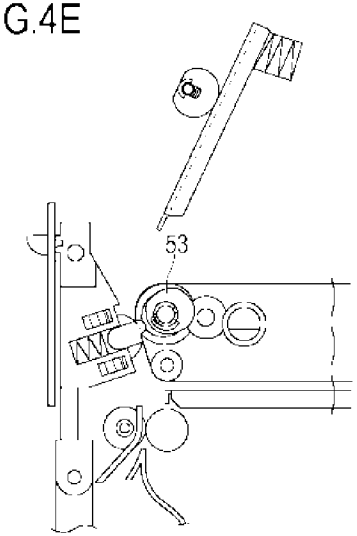

When the fixing cams 67 are further rotated by about 180 degrees as shown in FIG. 4E, the pressurization plates 66 are pressed by the fixing cams 67 and the relative position between the fixing roller 63 and the heating members of the fixing unit 60 is arranged at the fixing nip cancellation position again. At this time, the separation cams 53 are further rotated by about 90 degrees. Thus, the secondary transfer roller 12 that has been retreated to the separation position by the separation cams 53 finishes its movement from the separation position to the contact position again and contacts the intermediate transfer belt 10. This position is used for a paper jam or the like at the fixing nip. Note that the state of FIG. 4E corresponds to the state of D in FIG. 5.

Figure 4F:
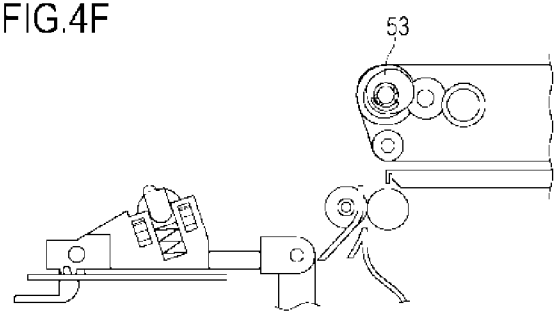

Then, when the secondary transfer unit 70 is closed after a paper jam is handled as shown in FIG. 4F, the separation cams 53 are still arranged at the same position as that shown in FIG. 4E. Since the secondary transfer unit 70 is not closed when the secondary transfer roller 12 is arranged at the separation position, a reaction force does not increase. That is, when the secondary transfer unit 70 is opened and moved to the opening position, the fixing cams 67 press the pressurization plates 66 to create a state in which a fixing nip pressure is cancelled. However, the separation cams 53 are separated from the bearings 71, a rotation phase is rotated (moved) from a pressing phase (pressing position) at which a pressing force for positioning the secondary transfer roller 12 at the transfer nip cancellation position is applied to the bearings 71 to a cancellation phase (cancellation position) at which the pressing force is cancelled. Therefore, the bearings 71 do not receive the pressing force from the separation cams 53 when the secondary transfer unit 70 is closed. Accordingly, an operation force used when the secondary transfer unit 70 is closed in the configuration of the present embodiment is only required to be smaller than an operation force used when the fixing cams 67 press the pressurization plates 66 to cancel a fixing nip pressure and the separation cams 53 press the bearings 71.

Figure 11:
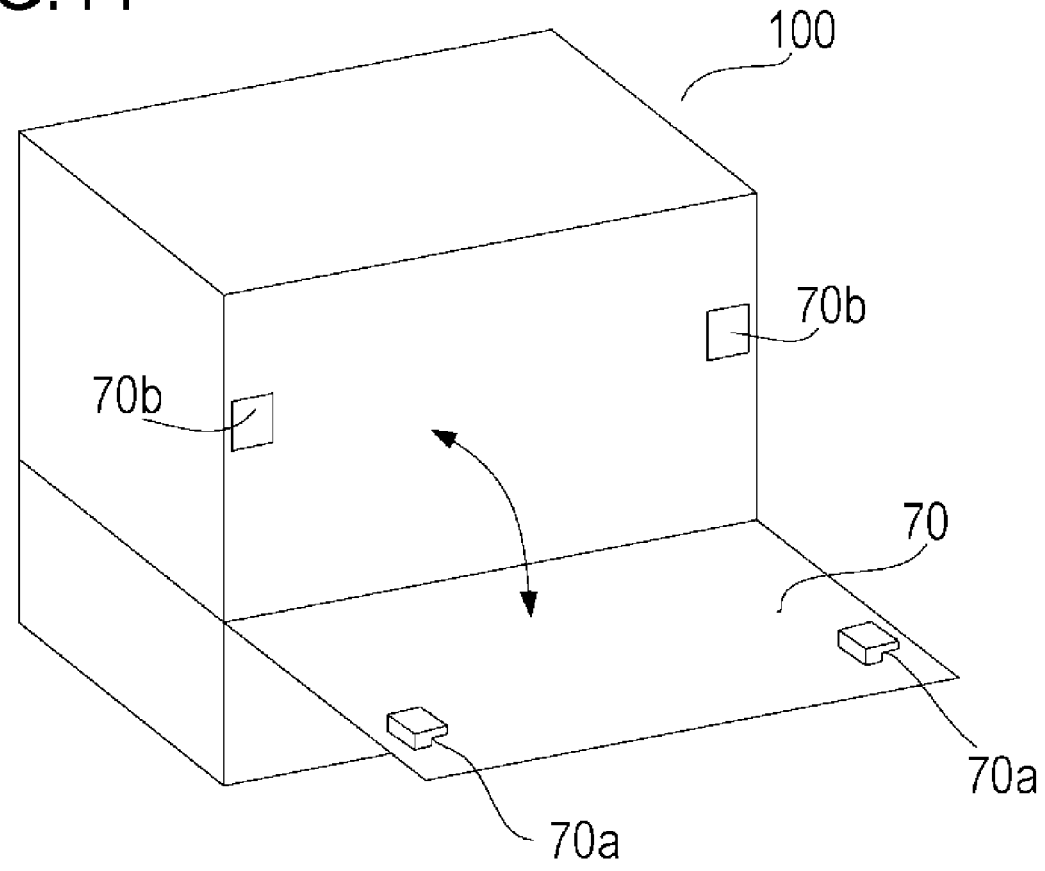
FIG. 11 is a view of a locking mechanism for the secondary transfer unit in the first embodiment of the present invention.

Further, a locking mechanism capable of locking the secondary transfer unit 70 at the closing position in the present embodiment will be described with reference to FIG. 11. In the secondary transfer unit 70, latches 70*a* serving as engaging portions are respectively provided at totally two places corresponding to locking units 70*b* (engaged portions) on an apparatus body side. When the secondary transfer unit 70 is moved from the opening position to the closing position, the latches 70*a* engage the corresponding locking units 70*b* and reach engaged positions. Thus, the secondary transfer unit 70 is locked at the closing position. The locking mechanism for retaining the secondary transfer unit 70 in a closed state is arranged at parts near both ends of the secondary transfer unit 70 as described above, but its locking performance remains the same since a reaction force does not increase.

As a method for detecting the position of the secondary transfer roller 12, the following method is used instead of providing a detection sensor. A secondary transfer bias is applied to the secondary transfer roller 12 in the state of B in FIG. 5 (FIG. 4C) or the state of D in FIG. 5 (FIG. 4E), and a current flowing at this time is detected to measure a current value. Here, a current value detected when the secondary transfer roller 12 is separated from the intermediate transfer belt 10 stretched by the driving roller 13 is made lower than a current value detected when the secondary transfer roller 12 is in contact with the intermediate transfer belt 10 stretched by the driving roller 13. In the present embodiment, the position of the secondary transfer roller 12 is detected on the basis of this property to determine the contact or separation state of the secondary transfer roller 12 with respect to the intermediate transfer belt 10. Finally, when the fixing cams 67 are rotated by about 180 degrees from the D state of FIG. 5 (FIG. 4E), the fixing cams 67 are separated from the pressurization plates 66. As a result, the fixing unit 60 is arranged at the fixing position. The separation cams 53 are further rotated by about 90 degrees and arranged at the position of A in FIG. 5 (FIG. 4A). That is, the secondary transfer roller 12 is returned to the contact position at which the secondary transfer roller 12 contacts the intermediate transfer belt 10 stretched by the driving roller 13.

As described above, the image forming apparatus 100 of the present embodiment is provided with the separation cams 53 for the contact and separation of the secondary transfer roller 12 and the mechanism for cancelling (or reducing) a fixing nip pressure. In addition, the image forming apparatus 100 is configured to transmit drive from the fixing cams 67 to the separation cams 53, make their operations interlocked with each other, and set a reduction gear ratio from the fixing cams 67 to the separation cams 53 at 2:1 to be capable of taking at least three states such as a printable state, a state at the time of shipment or long-term storage, and a paper jam handling state. That is, the image forming apparatus 100 is configured to be capable of taking at least the following three states: (i) a first state in which the relative position between the fixing roller 63 and the heating members 64 is arranged at the fixing position and the secondary transfer roller 12 is arranged at the contact position (transfer position) at which the secondary transfer roller 12 contacts the intermediate transfer belt 10; (ii) a second state in which the relative position between the fixing roller 63 and the heating members 64 is arranged at the fixing nip cancellation position and the secondary transfer roller 12 is arranged at the separation position (transfer nip cancellation position) at which the secondary transfer roller 12 is separated from the intermediate transfer belt 10; and (iii) a third state in which the relative position between the fixing roller 63 and the heating members 64 is arranged at the fixing nip cancellation position and the secondary transfer roller 12 is arranged at the transfer position with respect to the intermediate transfer belt 10. Thus, it is possible to realize the separation of the secondary transfer roller 12 without degrading operability (usability) or locking performance. Further, it is not necessary to separately provide a mechanism for reducing a load to close the secondary transfer unit 70. Therefore, it is possible to reduce a load to close the secondary transfer unit 70 without upsizing the image forming apparatus 100. Further, it is not necessary to newly provide a unit for detecting the contact and separation of the secondary transfer roller 12 according to the configuration of the present embodiment.

Thus, it is possible to prevent an image failure caused by the local deformation of the secondary transfer roller 12 or the intermediate transfer belt 10 due to long-term storage. Further, it is possible to prevent the separation of the secondary transfer roller 12 at the time of shipment from a factory.

In addition, the secondary transfer roller 12 is separated from the intermediate transfer belt 10 during the cleaning of the intermediate transfer belt 10 caused by the absence of a paper, a paper delay, or the like. Thus, it is possible to more reliably avoid the attachment of toner to the secondary transfer roller 12.

Further, by smoothly reducing the diameter of the separation cams 53 from the separation to contact of the secondary transfer roller 12 as a cam shape or making the rotation speed of the separation cams 53 half of the rotation speed of the fixing cams 67, the diameter from the rotation center of the cams to contact portions with the bearings 71 is gently changed. Accordingly, it is possible to reduce sound generated when the secondary transfer roller 12 contacts the intermediate transfer belt 10. In addition, the separation cams 53 are not rotated against vibration, dropping, or the like during transportation after shipment from a factory and are therefore reliable.

Note that the reduction gear ratio from the fixing cams 67 to the separation cams 53 is 2:1 in the present embodiment but is not limited to this. That is, if the reduction gear ratio from the fixing cams 67 to the separation cams 53 is an integer ratio (for example, 3:1 or 4:1), the secondary transfer roller 12 contacts the intermediate transfer belt 10 once every three times with respect to the contact and separation operations between the fixing roller 63 and the heating members 64 with, for example, a pressure reduction ratio of 3:1. Therefore, it is possible to determine the contact and separation of the secondary transfer roller 12 on the basis of a current value generated when the fixing nip is formed, a current value generated when the fixing nip is not formed, and the change interval of a current value, and is not necessary to newly provide a detection unit. Further, the separation cams 53 are arranged on the shaft of the driving roller 13 but may be arranged near the driving roller 13.

Further, it has been generally known that a maximum load (torque peak) is obtained immediately before the diameter of a cam becomes maximum. Therefore, in a case in which the reduction gear ratio from the fixing cams 67 to the separation cams 53 is 2:1 as in the present embodiment, the fixing cams 67 are formed to have the following shape according to the rotation angle of the cams. That is, if the fixing cams 67 repeatedly perform contact and separation with respect to the pressurization plates 66 when rotating by 180 degrees, the fixing cams 67 are formed to have a shape having a surface of which the diameter is gradually increased as the fixing cams 67 are rotated by 0 to 30 degrees, a surface of which the diameter becomes substantially maximum after a fixing nip pressure cancellation state is created as the fixing cams 67 are rotated by 30 to 150 degrees and contact the pressurization plates 66, and a surface of which the diameter is gradually reduced as the fixing cams 67 are rotated by 150 to 180 degrees.

On the other hand, the separation cams 53 are rotated by 90 degrees when the fixing cams 67 are rotated by 180 degrees, and formed to have a shape having a surface of which the diameter is gradually increased as the separation cams 53 are rotated by 0 to 30 degrees, a surface of which the diameter becomes substantially maximum after the separation cams 53 are rotated by 30 to 80 degrees and separated from the bearings 71, and a surface of which the diameter is gradually reduced as the separation cams 53 are rotated by 80 to 90 degrees.

When the shapes of the separation cams 53 and the fixing cams 67 are devised as described above, the fixing cams 67 are rotated by 60 degrees and the relative position between the fixing roller 63 and the heating members 64 is arranged at the fixing nip cancellation position at, for example, a time at which the separation cams are rotated by 30 degrees to be separated from the bearings 71. Since a state after the cancellation of a fixing nip pressure is created, the fixing cams 67 are brought into a state over maximum torque at the time of cancelling the fixing nip pressure. Therefore, it is possible to avoid the overlap of the peak of the maximum torque with that of the separation cams.

Further, at a phase at which a maximum load (maximum torque) is obtained immediately before the outer diameter of the fixing cams 67 becomes maximum as shown in FIG. 4B (a state in which the fixing cams 67 are rotated by about 126 degrees from the state of FIG. 4A), the phase of the separation cams 53 (a state in which the separation cams 53 are rotated by about 63 degrees from the state of FIG. 4A) is a phase before the outer diameter of the separation cams 53 becomes maximum. Thus, it is also possible to avoid the overlap of the peak of the maximum torque with that of the fixing cams. Note that the fixing cams 67 are rotated counterclockwise but the separation cams 53 are rotated clockwise. Therefore, the maximum load (maximum torque) of the separation cams 53 is obtained after the maximum load (maximum torque) of the fixing cams 67 is obtained.

Figure 9:
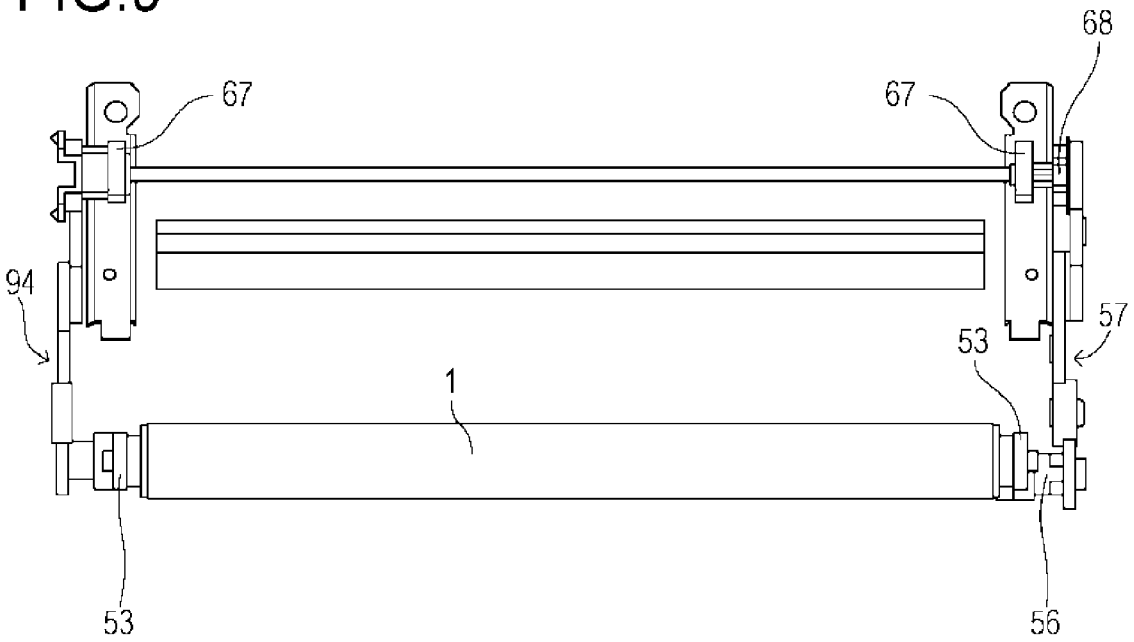
FIG. 9 is a schematic view of a driving configuration when seen from the side of the second transfer unit in the first to third embodiments.

By devising the shapes of the separation cams 53 and the fixing cams 67 to make the timing of the maximum load for cancelling a fixing nip pressure and the timing of the maximum load for separating the secondary transfer roller 12 different from each other, it is possible to reduce the maximum load of a motor 96 serving as a driving source. Further, by making the shapes of the two separation cams 53 different from each other, it is possible to reduce the maximum load or soften sound generated when the secondary transfer roller 12 contacts the intermediate transfer belt 10. The driving configuration is arranged as shown in FIG. 3, but drive may be transmitted from the fixing cams 67 at both ends to the separation cams 53 as shown in FIG. 9.

Second Embodiment

Next, a configuration peculiar to the present embodiment will be described with reference to FIGS. 6A to 6D and FIG. 7. FIGS. 6A to 6D are views showing the contact and separation of a secondary transfer roller 12 in the present embodiment. FIG. 7 is a view showing the positional relationship between a fixing unit 60 and a secondary transfer unit 70 in the present embodiment. In the present embodiment, the secondary transfer roller 12 is not configured to contact an intermediate transfer belt 10 but is configured to contact the intermediate transfer belt 10 with a reduced pressure or be slightly separated from the intermediate transfer belt 10 when used in paper clogging or the like.

Figure 6A:
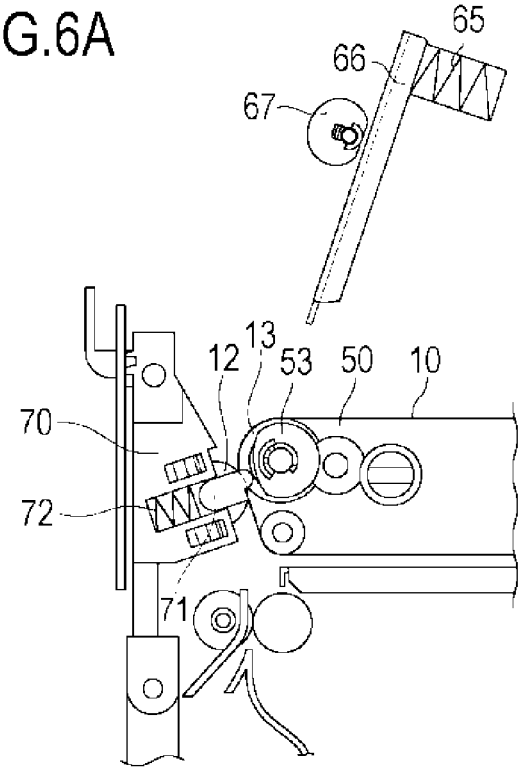
FIGS. 6A to 6D are schematic views showing the contact and separation of a secondary transfer roller in the second embodiment.

FIG. 6A shows a state in which the relative position between a fixing roller 63 and heating members 64 of the fixing unit 60 is arranged at a fixing position, the secondary transfer unit 70 is arranged at a closing position described above, and printing is allowed. This state corresponds to the state of A in FIG. 7. That is, a fixing nip is not cancelled in the fixing unit 60 like the first embodiment. In the secondary transfer unit 70, the secondary transfer roller 12 is arranged at a contact position (transfer position) at which the secondary transfer roller 12 contacts the intermediate transfer belt 10 like the first embodiment.

Figure 6B:
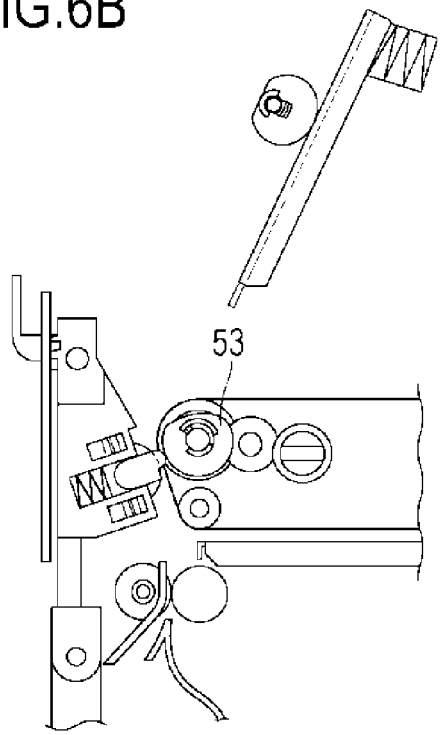

Here, when fixing cams 67 are rotated by about 180 degrees as shown in FIG. 6B, pressurization plates 66 are pressed by the fixing cams 67 and the relative position between the fixing roller 63 and the heating members 64 of the fixing unit 60 is arranged at a fixing nip cancellation position. Therefore, a fixing nip pressure is cancelled. At this time, the separation cams 53 are rotated by a substantially half angle, that is, about 90 degrees. As a result, bearings 71 are retreated by being pressed by the separations cams 53, and the secondary transfer roller 12 is moved from a contact position (transfer position) to a separation position (transfer nip cancellation position) described above and separated from the intermediate transfer belt 10. This position is used at the time of shipment from a factory, long-term storage during usage by a user, or the like. Note that the state of FIG. 6B corresponds to the state of B in FIG. 7.

Figure 6C:
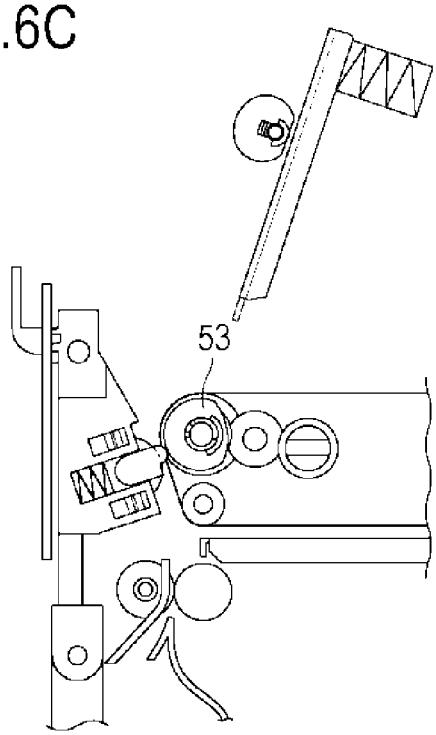

When the fixing cams 67 are further rotated by about 180 degrees as shown in FIG. 6C, the fixing cams 67 are separated from the pressurization plates 66 and the fixing unit 60 is arranged at the fixing position again. The separation cams 53 are further rotated by about 90 degrees, the secondary transfer roller 12 is in a state of being moved from the separation position to the contact position, and the secondary transfer roller 12 is moved to an intermediate position at which the secondary transfer roller 12 is slightly separated from the intermediate transfer belt 10. At this time, the secondary transfer roller 12 is arranged at a position at which the contact pressure between the secondary transfer roller 12 and the intermediate transfer belt 10 is made lower than a contact pressure generated when the secondary transfer roller 12 is arranged at the contact position. This state corresponds to the state of C in FIG. 7.

Figure 6D:
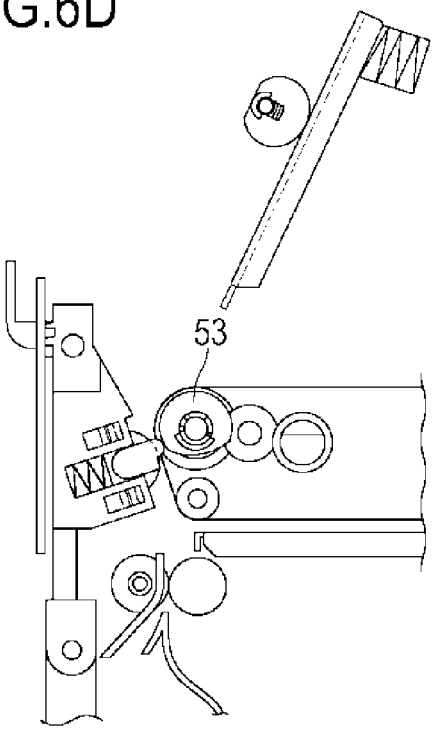

When the fixing cams 67 are further rotated by about 180 degrees as shown in FIG. 6D, the fixing unit 60 is arranged at a fixing pressure cancellation position and the separation cams 53 are further rotated by about 90 degrees. At this time, the secondary transfer roller 12 is still arranged at the intermediate position. Further, the contact pressure between the secondary transfer roller 12 and the intermediate transfer belt 10 is made lower than a contact pressure generated when the secondary transfer roller 12 is arranged at the contact position. The secondary transfer roller 12 that has been retreated by the separation cams 53 is slightly separated from the intermediate transfer belt 10. This position is used for a paper jam or the like. The state of FIG. 6D corresponds to the state of D in FIG. 7. Note that the secondary transfer roller 12 may be configured to contact the intermediate transfer belt 10 with a reduced pressure instead of being slightly separated from the intermediate transfer belt 10.

As a method for detecting the position of the secondary transfer roller 12, a current flowing through the secondary transfer roller 12 is detected to measure a current value in the state of B or the state of C in FIG. 7 like the first embodiment instead of providing a detection sensor. The position of the secondary transfer roller 12 is detected on the basis of this current value to determine the contact and separation of the secondary transfer roller 12. When the fixing cams 67 are rotated by about 180 degrees from the state of D in FIG. 7, the fixing cams 67 are separated from the pressurization plates 66. As a result, the fixing unit 60 is arranged at the fixing position. The separation cams 53 are further rotated by about 90 degrees and arranged at the position of A in FIG. 7 (FIG. 6A). That is, the secondary transfer roller 12 is returned to the contact position at which the secondary transfer roller 12 contacts the intermediate transfer belt 10.

As described above, the image forming apparatus of the present embodiment is, besides having the configuration in the first embodiment, configured so that the secondary transfer roller 12 is capable of being slightly separated from the intermediate transfer belt 10 with a change in the shape of the separation cams 53. That is, the image forming apparatus is configured to be capable of taking at least the following three states: (i) a first state in which the relative position between the fixing roller 63 and the heating members 64 is arranged at the fixing position and the secondary transfer roller 12 is arranged at the contact position (transfer position) at which the secondary transfer roller 12 contacts the intermediate transfer belt 10; (ii) a second state in which the relative position between the fixing roller 63 and the heating members 64 is arranged at the fixing nip cancellation position and the secondary transfer roller 12 is arranged at the separation position (transfer nip cancellation position) at which the secondary transfer roller 12 is separated from the intermediate transfer belt 10; and (iii) a third state in which the relative position between the fixing roller 63 and the heating members 64 is arranged at the fixing nip cancellation position and the secondary transfer roller 12 is arranged at the intermediate position between the contact position (transfer position) and the separation position (transfer nip cancellation position) or the transfer position with respect to the intermediate transfer belt 10. Therefore, it is possible to obtain not only the same effect as that of the first embodiment but also the following effect according to the configuration of the present embodiment. That is, by making the secondary transfer roller 12 contact the intermediate transfer belt 10 with a reduced pressure or making the secondary transfer roller 12 slightly separated from the intermediate transfer belt 10, it is possible to reduce a paper extracting force to handle a paper jam in a state in which the secondary transfer unit 70 is closed.

Third Embodiment

Figure 8:
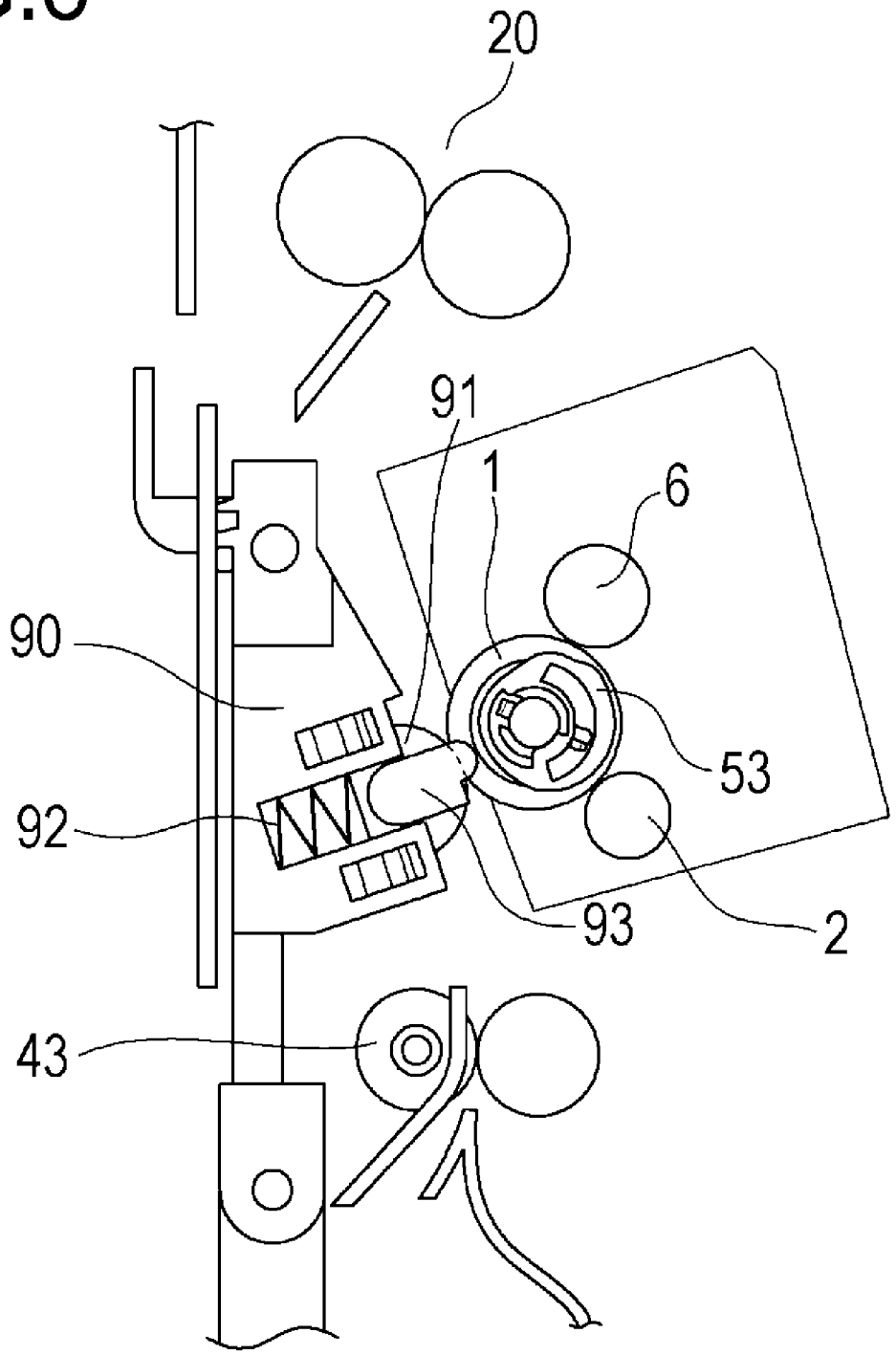
FIG. 8 is a view of a part near a transfer roller in the third embodiment.

Next, a configuration peculiar to the present embodiment will be described with reference to FIG. 8. FIG. 8 is an explanatory view of a part near a transfer roller 91 in an image forming apparatus according to the present invention. The image forming apparatus of the present embodiment is a monochrome printer. At a position facing the transfer roller 91, a photosensitive drum 1 is arranged and forms a nip with the transfer roller 91. Separation cams 53 for separating the transfer roller 91 from the photosensitive drum 1 are provided near both ends of the photosensitive drum 1. A transfer unit 90 is provided with the transfer roller 91 and bearings 93 having surfaces that contact the separation cams 53 at both ends of the transfer roller 91 like the first embodiment.

Since one of the bearings 93 is provided with a conductive member (not shown) for applying a bias to the transfer roller 91, the bearings 93 are not the same components. The transfer roller 91 is pressed by a transfer spring 92 serving as a transfer urging member via the bearings 93 and the conductive member (not shown), and the reaction force of the transfer spring 92 is received by the transfer unit 90. The transfer unit 90 is rotatably configured to be opened and closed with respect to the apparatus body of the image forming apparatus (movable to a closing position for closing the apparatus body and an opening position for opening the apparatus body). If a paper jam or the like occurs, the transfer unit 90 is moved to the opening position to open the apparatus body so that a user is allowed to handle the paper jam.

When the separation cams 53 serving as transfer nip control members are rotated in a state in which the transfer unit 90 is closed, the bearings 93 are moved against the urging force of the transfer spring 92 like the first embodiment. Thus, the transfer roller 91 is movable to a contact position (transfer position) and a separation position (transfer nip cancellation position).

A paper feeding apparatus (not shown) and a fixing unit 20 are arranged on an upstream side and a downstream side, respectively, in the paper conveying direction of the transfer unit 90. A fed paper is conveyed to the nip portion between the photosensitive drum 1 and the transfer roller 91, and toner images are transferred onto the paper. The paper is conveyed to the fixing unit 20 to fix the toner images. After that, the paper is discharged.

As the operation and driving configuration of the separation cams 53, a driving force is obtained from fixing cams 67 to drive the separation cams 53 like the first embodiment. The separation cams 53 are arranged as shown in FIG. 3 as the driving configuration, but drive may be transmitted from the fixing cams 67 at both ends to the separation cams 53 as shown in FIG. 9. The contact and separation of the transfer roller 91 are the same as the operations of the secondary transfer roller 12 in FIGS. 4A to 4F and FIG. 5 according to the first embodiment.

As described above, the image forming apparatus of the present embodiment is also provided with the separation cams 53 for the contact and separation of the transfer roller 91 and a mechanism for cancelling (or reducing) a fixing nip pressure. In addition, the image forming apparatus is configured to transmit drive from the fixing cams 67 to the separation cams 53, make their operations interlocked with each other, and set a reduction gear ratio from the fixing cams 67 to the separation cams 53 at 2:1 to be capable of taking at least three states such as a printable state, a state at the time of shipment or long-term storage, and a paper jam handling state. Therefore, it is possible to realize the separation of the transfer roller 91 without degrading operability (usability) or locking performance. Further, it is not necessary to separately provide a mechanism for reducing a load to close the transfer unit 90. Therefore, it is possible to reduce a load to close the transfer unit 90 without upsizing the image forming apparatus. Further, it is not necessary to newly provide a unit for detecting the contact and separation of the transfer roller 91 according to the configuration of the present embodiment.

Thus, it is possible to prevent an image failure caused by the local deformation of the transfer roller 91 due to long-term storage. Further, it is possible to prevent the separation of the transfer roller 91 at the time of shipment from a factory.

In addition, the transfer roller 91 is separated from the photosensitive drum 1 at the time of cleaning the photosensitive drum 1 caused by the absence of a paper, a paper delay, or the like. Thus, it is possible to more reliably avoid the attachment of toner to the transfer roller 91.

Further, by smoothly reducing the diameter of the separation cams 53 from the separation to contact of the transfer roller 91 as a cam shape or making the rotation speed of the separation cams 53 half (substantially half) of the rotation speed of the fixing cams 67, it is possible to reduce sound generated when the transfer roller 91 contacts the photosensitive drum 1. In addition, the separation cams 53 are not rotated against vibration, droppage, or the like during transportation after shipment from a factory and are therefore reliable.

Note that the reduction gear ratio from the fixing cams 67 to the separation cams 53 is 2:1 in the present embodiment but is not limited to this. That is, if the reduction gear ratio from the fixing cams 67 to the separation cams 53 is an integer ratio (for example, 3:1 or 4:1), the transfer roller 91 contacts the photosensitive drum 1 once every three times with respect to the contact and separation operations between the fixing roller 63 and the heating members 64 with, for example, a pressure reduction ratio of 3:1. Therefore, it is possible to determine the contact and separation of the transfer roller 91 on the basis of a current value generated when the fixing nip is formed, a current value generated when the fixing nip is not formed, and the change interval of a current value, and is not necessary to newly provide a detection unit. Further, the separation cams 53 are arranged on the shaft of the photosensitive drum 1 but may be arranged near the photosensitive drum 1.

By devising the shapes of the separation cams 53 and the fixing cams 67 like the first embodiment, it is possible to make the timing of a maximum load for cancelling a fixing nip pressure and the timing of a maximum load for separating the transfer roller 91 different from each other in the present embodiment as well. As a result, it is possible to reduce the maximum load of a motor (not shown) serving as a driving source.

Further, by making the shapes of the two separation cams 53 different from each other, it is possible to reduce the maximum load or soften sound generated when the transfer roller 91 contacts the photosensitive drum 1. The contact and separation of the transfer roller 91 may be the operations of the secondary transfer roller 12 of the second embodiment.

Note that it is necessary to consider the fact that, when the transfer unit 90 is opened, an operation force for closing the transfer unit 90 is made higher than an operation force at the contact of the transfer roller 91. A driving configuration is arranged as shown in FIG. 3, but drive may be transmitted from the fixing cams 67 at both ends to the separation cams 53 as shown in FIG. 9.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-109157, filed on Jun. 24, 2020, which is hereby incorporated by reference herein in its entirety.

What is claimed is:

1. An image forming apparatus comprising:

an apparatus body;

an image bearing member that is provided in the apparatus body and bears a toner image;

a transfer roller that forms a transfer nip to sandwich a recording material between the transfer roller and the image bearing member, and transfers the toner image onto the recording material inside the apparatus body;

a transfer unit that is provided in the apparatus body to be movable to an opening position for opening the inside of the apparatus body and to a closing position for closing the inside of the apparatus body, at the closing position, the transfer unit supporting the transfer roller to be movable to a transfer position, at which the transfer unit forms the transfer nip with the image bearing member, and to a transfer nip cancellation position, at which the transfer unit does not form the transfer nip with the image bearing member;

a transfer nip control member that is provided in the apparatus body to be movable to a pressing position, at which the transfer nip control member applies a pressing force for positioning the transfer roller at the transfer nip cancellation position to the transfer unit at the closing position, and to a cancellation position, at which the transfer nip control member cancels the pressing force;

a fixing portion that has a fixing roller for forming a fixing nip to sandwich the recording material and a facing member facing the fixing roller and fixes the toner image onto the recording material; and a fixing nip control mechanism for changing a relative position between the fixing roller and the facing member to a fixing position, at which the fixing nip is formed, and a fixing nip cancellation position, at which the fixing nip is not formed, wherein the image forming apparatus includes an interlocking mechanism for moving the transfer nip control member from the cancellation position to the pressing position in conjunction with a cancellation operation of the fixing nip by the fixing nip control mechanism, and the image forming apparatus is capable of taking, as a combination state of a relative position between the fixing roller and the facing member and a position of the transfer roller, at least (i) a first state in which the relative position is arranged at the fixing position and the transfer roller is arranged at the transfer position, (ii) a second state in which the relative position is arranged at the fixing nip cancellation position and the transfer roller is arranged at the transfer nip cancellation position, and (iii) a third state in which the relative position is arranged at the fixing nip cancellation position and the transfer roller is arranged at at least one of an intermediate position between the transfer position and the transfer nip cancellation position, and the transfer position, wherein the intermediate position is a position at which the transfer roller is separated from the image bearing member.

2. An image forming apparatus comprising:

an apparatus body;

an image bearing member that is provided in the apparatus body and bears a toner image;

a transfer roller that forms a transfer nip to sandwich a recording material between the transfer roller and the image bearing member, and transfers the toner image onto the recording material inside the apparatus body;

a transfer unit that is provided in the apparatus body to be movable to an opening position for opening the inside of the apparatus body and to a closing position for closing the inside of the apparatus body, at the closing position, the transfer unit supporting the transfer roller to be movable to a transfer position, at which the transfer unit forms the transfer nip with the image bearing member, and to a transfer nip cancellation position, at which the transfer unit does not form the transfer nip with the image bearing member;

a transfer nip control member that is provided in the apparatus body to be movable to a pressing position, at which the transfer nip control member applies a pressing force for positioning the transfer roller at the transfer nip cancellation position to the transfer unit at the closing position, and to a cancellation position, at which the transfer nip control member cancels the pressing force;

a fixing portion that has a fixing roller for forming a fixing nip to sandwich the recording material and a facing member facing the fixing roller and fixes the toner image onto the recording material; and a fixing nip control mechanism for changing a relative position between the fixing roller and the facing member to a fixing position, at which the fixing nip is formed, and a fixing nip cancellation position, at which the fixing nip is not formed, wherein the image forming apparatus includes an interlocking mechanism for moving the transfer nip control member from the cancellation position to the pressing position in conjunction with a cancellation operation of the fixing nip by the fixing nip control mechanism, and the image forming apparatus is capable of taking, as a combination state of a relative position between the fixing roller and the facing member and a position of the transfer roller, at least (i) a first state in which the relative position is arranged at the fixing position and the transfer roller is arranged at the transfer position, (ii) a second state in which the relative position is arranged at the fixing nip cancellation position and the transfer roller is arranged at the transfer nip cancellation position, and (iii) a third state in which the relative position is arranged at the fixing nip cancellation position and the transfer roller is arranged at at least one of an intermediate position between the transfer position and the transfer nip cancellation position, and the transfer position, and the intermediate position is a position at which the transfer roller contacts the image bearing member but a contact pressure between the transfer roller and the image bearing member is lower than a contact pressure generated when the transfer roller is at the transfer position.

3. The image forming apparatus according to claim 1, further comprising a detection unit that detects a position of the transfer roller.

4. The image forming apparatus according to claim 3, wherein the image bearing member is a belt that bears a toner image, the image forming apparatus further comprising a facing roller that is arranged on an inner surface side of the belt, the facing roller sandwiching the belt between the facing roller and the transfer roller positioned on an outer surface side of the belt, and forming the transfer nip between the belt and the transfer roller, and the transfer nip control member is a cam member that rotates about a rotational axis coaxial with the facing roller and has a cam shape having a pressing phase representing the pressing position and a cancellation phase representing the cancellation position.

5. The image forming apparatus according to claim 3, wherein the image bearing member is a photosensitive drum, and the transfer nip control member is a cam member that rotates about a rotational axis coaxial with the photosensitive drum and has a cam shape configured to have a pressing phase representing the pressing position and a cancellation phase representing the cancellation position as rotational phases.

6. The image forming apparatus according to claim 4, wherein the fixing nip control mechanism includes a fixing cam member having a cam shape that periodically changes the relative position between the fixing roller and the facing member to the fixing position and the fixing nip cancellation position, and a reduction gear ratio from the fixing cam member to the cam member serving as the transfer nip control member is an integer ratio.

7. The image forming apparatus according to claim 6, wherein when the fixing cam member is rotated by a prescribed angle, a rotation angle of the cam member serving as the transfer nip control member is smaller than the rotation angle of the fixing cam member.

8. The image forming apparatus according to claim 6, wherein when the fixing cam member is rotated by a prescribed angle, a rotation angle of the cam member serving as the transfer nip control member is substantially half of the rotation angle of the fixing cam member.

9. The image forming apparatus according to claim 1, wherein the transfer unit has a transfer urging member that applies to the transfer roller an urging force for positioning the transfer roller at the transfer position, the fixing portion has a fixing urging member that applies to the fixing roller and/or the facing member an urging force for positioning the fixing roller and the facing member at the fixing position, and the interlocking mechanism interlocks operations of the fixing nip control mechanism and the transfer nip control member with each other so that timing at which a maximum load is generated when the fixing nip control mechanism moves the fixing roller and the facing member from the fixing position to the fixing nip cancellation position against an urging force of the fixing urging member and timing at which a maximum load is generated when the transfer nip control member moves the transfer roller from the transfer position to the transfer nip cancellation position against an urging force of the transfer urging member are not overlapped with each other.

10. The image forming apparatus according to claim 1, further comprising a locking mechanism having an engaging portion that engages the transfer unit so that the transfer unit is locked at the closing position, wherein the locking mechanism is configured so that the transfer unit reaches an engaged position at which the transfer unit is engaged by the engaging portion when the transfer unit moves from the opening position to the closing position.

* * * * *